US006409517B2

(12) United States Patent
Malnati

(10) Patent No.: US 6,409,517 B2
(45) Date of Patent: Jun. 25, 2002

(54) DEVICE FOR ELECTRICALLY POWERING PRESENT ON A PART OF HOUSEHOLD ELECTRICAL APPLIANCE WHICH IS MOVEABLE RELATIVE TO THE MAIN STRUCTURE OF THIS LATTER

(75) Inventor: Roberto Malnati, Bodio Lomnago (IT)

(73) Assignee: Whirlpool Corporation, Michigan ( * ) Notice: Subject to any disclaimer, the term of this patent is extended or adjusted under 35 U.S.C. 154(b) by 0 days.

(21) Appl. No.: 09/897,862

(22) Filed: Jul. 2, 2001

(30) Foreign Application Priority Data

Jul. 4, 2000 (IT) ..... M1000400 U

(51) Int. Cl.[7] ..... H01R 11/30

(52) U.S. Cl. ..... 439/38; 439/950

(58) Field of Search ..... 439/38, 950, 246, 439/165

(56) References Cited

U.S. PATENT DOCUMENTS 3,840,795 A * 10/1974 Roszyk et al. ..... 320/108
4,838,797 A * 6/1989 Dodier ..... 439/38
5,264,776 A * 11/1993 Hulsey ..... 320/108
5,930,353 A * 7/1999 Lee et al. ..... 379/433

* cited by examiner

*Primary Examiner*—Tulsidas Patel
(74) *Attorney, Agent, or Firm*—Stephen Krefman; Robert O. Rice; Thomas J. Roth

(57) ABSTRACT

A device for electrically powering user devices present on a part of a household electrical appliance movable relative to a fixed main structure of this latter, such as a door, for example of a refrigerator, openable away from the refrigerator cabinet, electrical conductors being present in said movable part and in said fixed structure. The device comprises a magnetic induction transformer arranged to connect said electrical conductors together, said induction transformer being positioned between said movable part and said fixed structure.

5 Claims, 2 Drawing Sheets

DEVICE FOR ELECTRICALLY POWERING PRESENT ON A PART OF HOUSEHOLD ELECTRICAL APPLIANCE WHICH IS MOVEABLE RELATIVE TO THE MAIN STRUCTURE OF THIS LATTER

BACKGROUND OF THE INVENTION

1. Field of the Invention

The present invention relates to a hinge or similar device for a refrigerator cabinet having a door housing electrical components.

2. Description of the Related Art

Movable parts of household electrical appliances (such as refrigerator or dishwasher doors movable relative to the main structure) are known to include electrically powered user devices. For example it is known to position a drink or ice dispenser on a refrigerator door, or to position electrical controls for user devices (or for controlling the entire refrigerator) on the refrigerator door.

Dishwasher doors are known to include controls and dispensers for detergent and rinse additive materials.

The electric power to user devices or control members in the door and their connection to other appliance components in the main structure passes through electrical conductors associated with both the door and main structure of the appliance. Means to connect electrical conductors in the door and in the main structure of the household appliance are required.

SUMMARY OF THE INVENTION

An object of the present invention is to provide a device which enables said electrical conductors associated with components in an appliance door and with the conductors in the main structure to be easily and safely connected.

Another object is to provide a door hinge or similar device which is of simple construction and low cost, so as not to negatively affect the appliance cost to a substantial extent.

A further object is to provide a door hinge which, in the case of a refrigerator, enables the mounting of the door on the refrigerator cabinet to be reversed.

These and further objects which will be apparent to the expert of the art are attained by a hinge in accordance with the accompanying claims.

BRIEF DESCRIPTION OF THE DRAWINGS

The present invention will be more apparent from the accompanying drawings, which are provided by way of non-limiting example and in which.

DESCRIPTION OF THE PREFERRED EMBODIMENT

Figure 1:
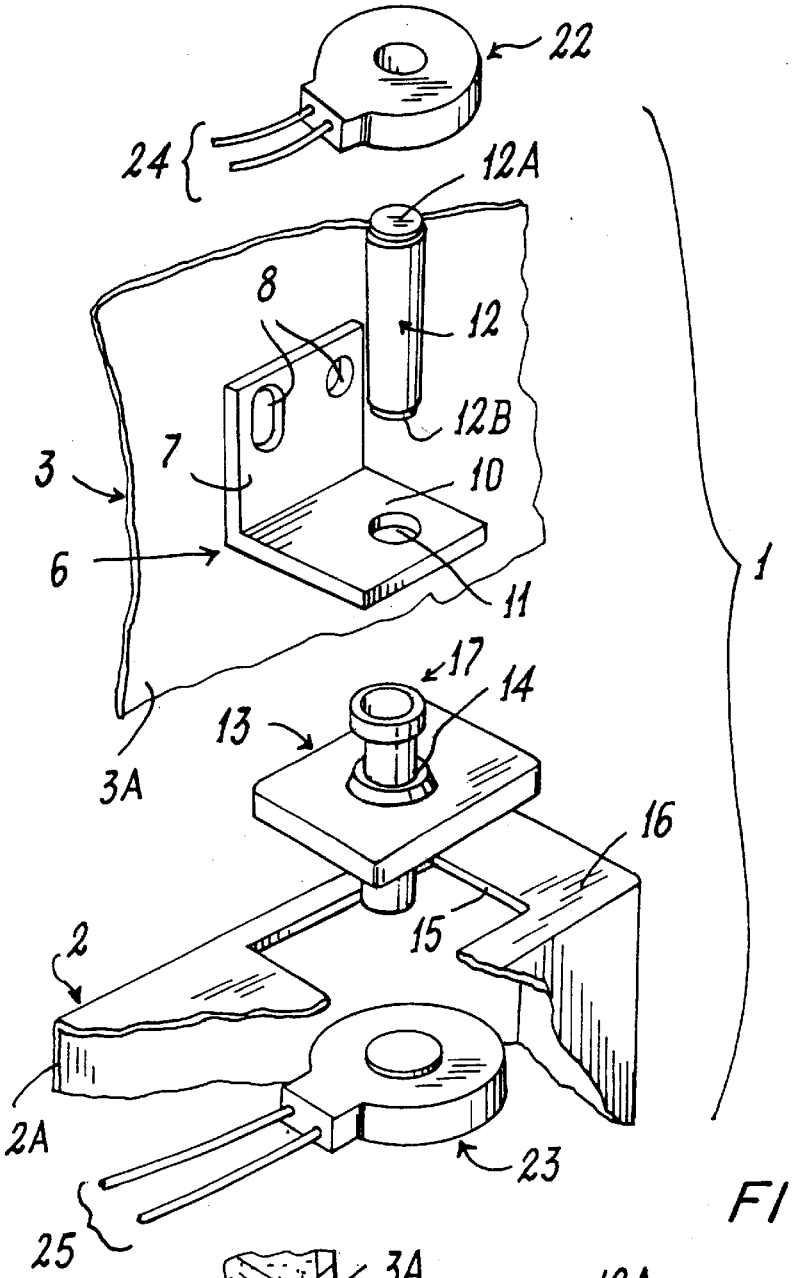
FIG. 1 is an exploded view of a device of the invention.
Figure 2:
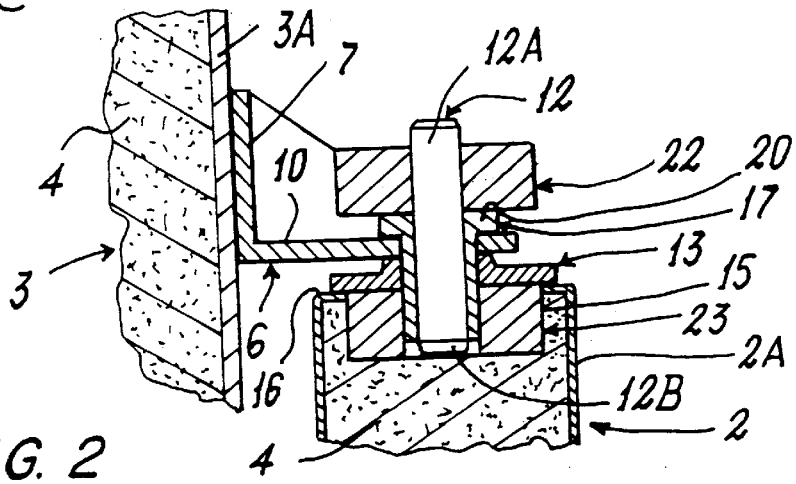
FIG. 2 is a section through the device of FIG. 1 during its use.

With reference to FIGS. 1 and 2, a hinge according to the invention is indicated overall by 1, its purpose being to act as a connection hinge between a refrigerator door 2 and the cabinet or main structure 3 of the refrigerator. Both the door 2 and the cabinet 3 have an outer shell 2A and 3A respectively, enclosing insulating material 4, for example expanded polyurethane.

The hinge 1 comprises a (non-metal) L-shape support element 6 having, on one side 7, holes 8 for adjustably fastening element 6 to the cabinet 3. On the other side 10, element 6 has a hole 11 to receive a metal hinge pin 12. Hinge pin 12 also cooperates with hinge member 13. Hinge member 13 is preferably made of antifriction plastic, provided with a hole 14 to receive the hinge pin 12. Hinge member 13 which acts as a rotation seat for the pin 12 is inserted into a seat 15 provided on one edge 16 of the door 2. Between hinge pin 12 and hole 14 there is preferably provided a tube 17, for protecting hinge pin 12, into which hinge pin 12 is inserted. Tube 17 has an end flange 20 which rests on side 10 of the element 6.

Located adjacent the opposite ends 12A and 12B of the pin 12 are two (annular) coils 22 and 23 connected to electrical conductors 24 and 25 respectively. The conductors 24 are connected in known manner to a usual alternating current mains power supply; the conductors 25 are connected to one or more electrical user devices provided on or inside the door 2. These user devices can be for example a refrigerator control panel or a drink or ice dispenser.

The coils 22 and 23 plus metal pin 12 define a transformer in which the hinge pin 12 constitutes the core. Consequently, by means of the invention, electrical power can be transferred by magnetic induction from the conductors 24 to the conductors 25 via the aforesaid transformer.

The solution is simple, is of easy implementation and is of safe use (for the user) as a reduction in the voltage fed to the conductors 25 can be obtained by means of the transformer.

Voltage reduction could also be obtained prior to the coil 22 (which in the example is fed with mains voltage).

Figure 3:
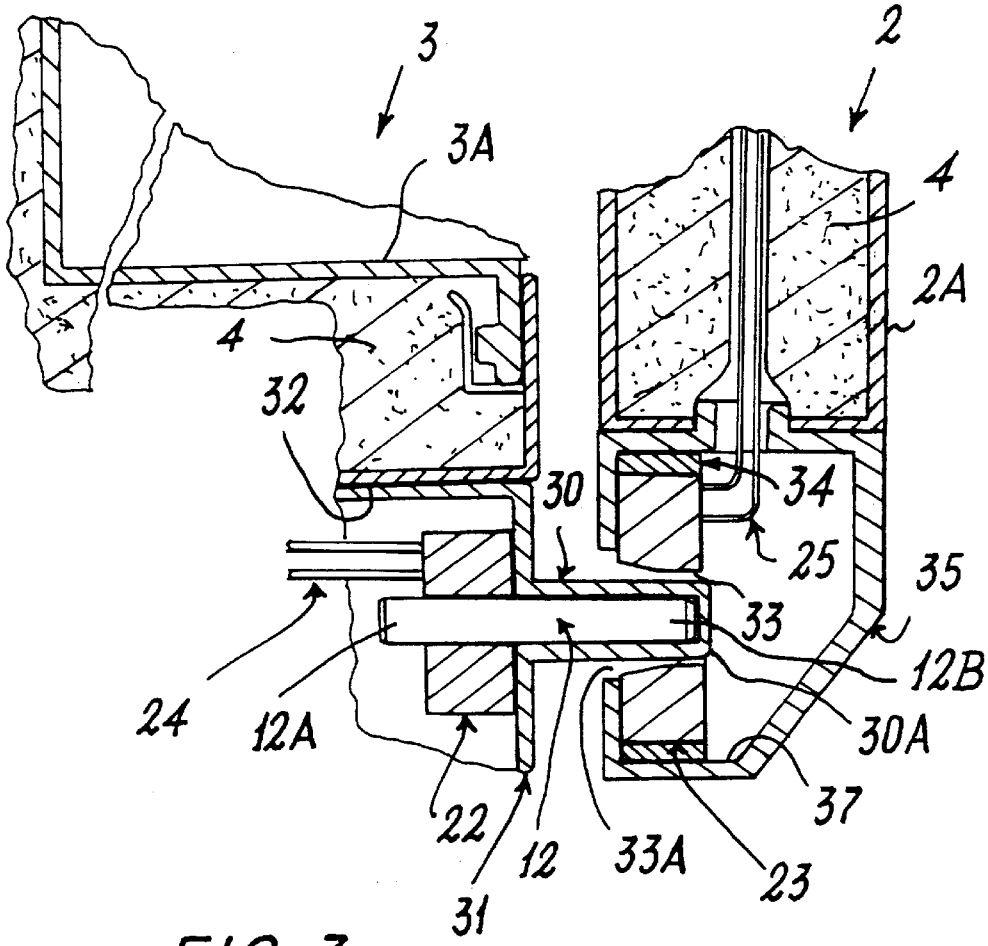
FIG. 3 is a section through an alternate embodiment of the invention during its use.
Figure 4:
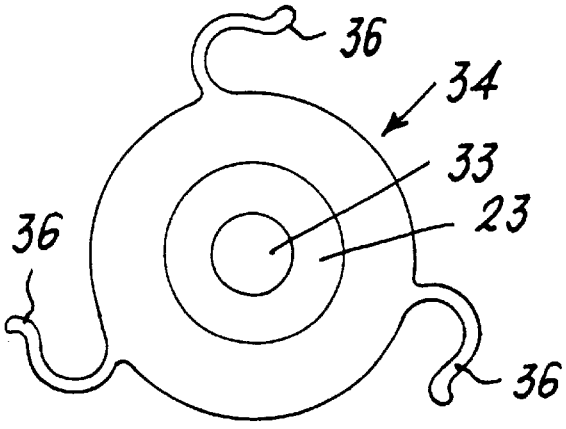
FIG. 4 shows a part of the device of FIG. 3.

An alternate embodiment of the invention is shown in FIGS. 3 and 4, in which parts corresponding to those already described are indicated by the same reference numerals. In the alternate embodiment, pin 12 is at least partly inserted into a projecting part 30 of a member 31 (of electrically insulating diamagnetic material) mounted to one side 32 of the main structure 3 of the refrigerator. Member 31 can be positioned below the main structure 3 to act as a container for electrical equipment of the refrigerator. The member 31 can however also be positioned on any other side of the main structure 3 against which the door 2 closes.

The projecting part 30 cooperates with a seat 33 (preferably flared at 33A), provided within a member 34 (of electrically insulating diamagnetic material) inserted into a support piece 35 associated with the door 2. Member 34 carries the coil 23 (which defines the seat 33) and is provided with elastic projections 36 cooperating with the walls 37 of the part 35 to enable the member 34 to undergo small movements during the insertion of the end 30A of the projecting part 30 into the seat 33 and hence receive projecting part 30 correctly and without jamming.

In the alternate embodiment, the pin 12 does not act as a hinge pin, but cooperates with the coil 23 (to define, together with the coil 22 associated with the member 31, the transformer for transferring power from the conductors 24 to the conductors 25 by magnetic induction) only when the door 2 is closed against the fixed structure of the appliance. This solution is particularly suitable if the user device or devices connected to the conductors 24 or 25 are provided with their own rechargeable batteries by which these user devices operate when the door 2 is open.

A particular embodiment of the invention applied to a refrigerator has been described. The invention is however applicable to any household electrical appliance in which a part movable relative to the main structure supports electrically powered members, such as a dishwasher door.

I claim:

1. A household electrical appliance having a door and a main structure, and a hinge for movably mounting the door to the main structure including a magnetic induction transformer for electrically coupling one or more electrical devices on said door with electrical elements on said main structure comprising:

a first hinge member mounted to said door and having hinge pin hole;

a second hinge member mounted to said main structure and having a hinge pin hole;

a first winding carried on said door adjacent said first hinge member;

a second winding carried on said main structure adjacent said second hinge member; and an elongated metal hinge pin that is positioned in the hole in said first hinge member and is positioned through the hole in said second hinge member to hinge said door to said main structure, said first winding being disposed adjacent one end of said hinge pin and said second winding being disposed adjacent the other end of said hinge pin such that said metal hinge pin forms the core for said transformer.

2. The household appliance as claimed in claim 1, wherein said first hinge member is formed of electrically insulating diamagnetic material that forms a rotation seat for said hinge pin.

3. The household appliance as claimed in claim 2, wherein the second hinge member is of electrically insulating diamagnetic material.

4. The household appliance as claimed in claim 3, wherein the first hinge member and the second hinge member are formed of plastic material.

5. The household appliance as claimed in claim 2, wherein the second winding is external to the main structure.

* * * * *